US006561889B1

(12) United States Patent
Xu et al.

(10) Patent No.: US 6,561,889 B1
(45) Date of Patent: May 13, 2003

(54) METHODS FOR MAKING REINFORCED WAFER POLISHING PADS AND APPARATUSES IMPLEMENTING THE SAME

(75) Inventors: Cangshan Xu, Fremont, CA (US); Eugene Y. Zhao, San Jose, CA (US); Fen Dai, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/752,509

(22) Filed: Dec. 27, 2000

(51) Int. Cl.[7] ..... B24D 11/00
(52) U.S. Cl. ..... 451/526; 451/533
(58) Field of Search ..... 451/526, 527, 451/528, 530, 533, 537; 15/230.12

(56) References Cited

U.S. PATENT DOCUMENTS

| | | | | |
|---|---|---|---|---|
| 5,573,444 | A | | 11/1996 | Ryoke et al. |
| 5,692,947 | A | | 12/1997 | Talieh et al. |
| 5,807,161 | A | | 9/1998 | Manor et al. |
| 5,858,140 | A | | 1/1999 | Berger et al. |
| 5,897,424 | A | | 4/1999 | Evans et al. |
| 5,924,917 | A | | 7/1999 | Benedict et al. |
| 6,017,265 | A | | 1/2000 | Cook et al. |
| 6,022,268 | A | | 2/2000 | Roberts et al. |
| 6,095,902 | A | | 8/2000 | Reinhardt |
| 6,149,506 | A | | 11/2000 | Deuscher |
| 6,155,910 | A | | 12/2000 | Lamphere et al. |
| 6,197,076 | B1 | | 3/2001 | Braunschweig et al. |
| 6,213,858 | B1 | * | 4/2001 | Lombardo ..... 451/526 |
| 6,217,434 | B1 | | 4/2001 | Roberts et al. |
| 6,234,875 | B1 | | 5/2001 | Pendergrass, Jr. |
| 6,293,852 | B1 | | 9/2001 | Roberts et al. |
| 6,315,634 | B1 | * | 11/2001 | Jensen et al. ..... 451/5 |
| 6,328,634 | B1 | | 12/2001 | Shen et al. |
| 6,328,642 | B1 | * | 12/2001 | Pant et al. ..... 451/307 |
| 6,361,409 | B1 | | 3/2002 | Vishwanathan et al. |

FOREIGN PATENT DOCUMENTS

| | | |
|---|---|---|
| EP | 0 451 944 A | 10/1991 |
| EP | 0 696 495 A1 | 2/1996 |
| EP | 0 893 203 A2 | 1/1999 |
| WO | WO 98/35785 A | 8/1998 |
| WO | WO 98/35786 | 8/1998 |
| WO | WO 00/34008 A | 6/2000 |
| WO | WO 01/15867 A1 | 3/2001 |

* cited by examiner

*Primary Examiner*—George Nguyen
*Assistant Examiner*—Dung Van Nguyen
(74) *Attorney, Agent, or Firm*—Martine & Penilla, LLP

(57) ABSTRACT

As one of many embodiments of the present invention, a seamless polishing apparatus for utilization in chemical mechanical polishing is provided. The seamless polishing apparatus includes a polishing pad where the polishing pad is shaped like a belt and has no seams. The seamless polishing apparatus also includes a base belt where the base belt includes a reinforcement layer and a cushioning layer. In addition, the cushioning layer is an intermediary layer between the polishing belt pad and the base belt.

35 Claims, 12 Drawing Sheets

METHODS FOR MAKING REINFORCED WAFER POLISHING PADS AND APPARATUSES IMPLEMENTING THE SAME

CROSS REFERENCE TO RELATED APPLICATIONS

This application is related to U.S. patent application Ser. No. 09/752,703, filed on Dec. 27, 2000, entitled "METHODS FOR MAKING REINFORCED WAFER POLISHING PADS UTILIZING DIRECT CASTING AND APPARATUSES IMPLEMENTING THE SAME."

BACKGROUND OF THE INVENTION

1. Field of the Invention

The present invention relates to chemical mechanical polishing (CMP) techniques and, more particularly, to the efficient, cost effective, and improved CMP operations.

2. Description of the Related Art

In the fabrication of semiconductor devices, there is a need to perform chemical mechanical polishing (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess metallization.

A chemical mechanical polishing (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12 in the prior art, which moves linearly in respect to the surface of the wafer 16. The belt 12 is a continuous belt rotating about rollers (or spindles) 20. The rollers are typically driven by a motor so that the rotational motion of the rollers 20 causes the polishing belt 12 to be driven in a linear motion 22 with respect to the wafer 16. Typically, the polishing belt 12 has seams 14 in different sections of the polishing belt 12.

The wafer 16 is held by a wafer carrier 18. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12. The polishing belt 12 is a continuous belt typically made up of a polymer material such as, for example, the IC 1000 made by Rodel, Inc. layered upon a supporting layer. The supporting layer is generally made from a firm material such as stainless steel. The polishing belt 12 is rotated by the rollers 20 which drives the polishing belt in the linear motion 22 with respect to the wafer 16. In one example, an air bearing platen 24 supports a section of the polishing belt under the region where the wafer 16 is applied. The platen 24 can then be used to apply air against the under surface of the supporting layer. The applied air thus forms an controllable air bearing that assists in controlling the pressure at which the polishing belt 12 is applied against the surface of the wafer 16. As mentioned, seams 14 of the polishing belt 12 are generally located in several different locations in the polishing belt 12. Therefore, the polishing belt is made up of multiple sheets of a polymer material that are connected together by, for example, an adhesive, stitching, or the like to form a continuous belt. A seam section 30 illustrates one of the seams 14, which will be discussed in greater detail in FIG. 1C. Therefore, during a CMP process, moisture from, for example, slurry may intrude into the inner portion of the polishing belt 12 through the seams 14. The moisture may then attack the adhesive holding the polishing belt and the supporting layer together thus causing delamination of the polishing belt from the supporting layer. Therefore, the prior art designs have serious delamination problems due to moisture intrusion into the seams 14. In addition, shear forces created between the support layer and the polishing belt 12 when moving over the rollers 20 can be a very serious destructive factor and also cause delamination. As a result, the life of the polishing belt may be shortened significantly. Such a shortening of polishing belt life may then cause a considerable decrease in wafer production. This problem is further described in reference to FIG. 1C.

FIG. 1C shows a magnified view of an exemplary seam section 30 after delamination has started to take place. The seam section 30 includes a seam 38, a polymer polishing layer 32 connected on top of a supporting layer 36 by an adhesive 42. Delaminations 40 start to occur between the polymer polishing layer 32 and the supporting layer 36 as the fluids start to attack the integrity of the adhesive material, and thus, the adhesive 42 will either itself start to come off of the supporting layer 36 and/or allow the polishing layer 32 to delaminate progressively as critical CMP operations are in progress. Additionally, when the polymer polishing layer 32 and the supporting layer 42 move over the rollers 20 (as shown in reference to FIG. 1C), shear forces may be created causing serious delaminatory damage.

During a CUT process, slurry is typically applied to the polishing belt 12 of FIGS. 1A and 1B. When this occurs, the moisture from the slurry may seep through the seam 38. In more detail, the delaminations 40 tend to form after continued use of a polishing belt because of the moisture seepage from a surface of the polishing belt down the seam 38 to the adhesive film 42. The moisture seepage can then break down the adhesive film 42. When this occurs, the different layers 32 and 36 of the polishing belt 12 may start to peel off, as described above, due to the loss in adhesion resulting in the delaminations 40. In addition, pressures and shear forces exerted on the polishing belt during the CMP process can serve to exacerbate matters and can greatly increase the creation of the delaminations 40. When the seam section 30 moves over rollers, the support layer 36 does not stretch very much thus defining a neutral axis. The polishing belt 12 on top of the supporting layer 36 typically stretches when it is bending over the roller because outer layers tend to stretch more than inner layers. When the seam section 30 is no longer on the rollers, the stretch disappears and the seam section 30 compresses. This constant stretch and compress cycles tend to create stress in the materials thus creating shear stress between the supporting layer 36 and the polishing belt 12. This shear stress may lead to delamination over time. The delaminations 40 tend to destabilize the polishing pad and significantly reduce the effectiveness and life of the polishing pad. As a result, the polishing pad of the prior art has a reduced life span and therefore wafer production throughput may be drastically reduced due to the time necessary to change the polishing pad. The reduced lifetime of polishing pads also results in the use of more polishing pads by a manufacturer thus incurring even more costs. In addition, if unanticipated delaminations occur, wafers polished by delaminated polishing belts may be defective thus creating further costs for a wafer manufacturer.

As indicated previously, changing pads on a polishing belt may be an extremely expensive and time consuming process. When changing pads, a polishing belt has to typically be sent back to the manufacturer and have the pad stripped from a base belt. This can cause a long period of wafer processing shutdown and can potentially decrease wafer production severely. Therefore, polishing belt structure which breaks down and delaminates after a short period of time may create extreme problems for entities requiring constant and consistent wafer production.

Unfortunately the prior art method and apparatus of CMP operations as described in reference to FIGS. 1A, 1B, and 1C have even more problems. The prior art apparatus also has problems with oxide removal where the topographical nature of the wafers include varying thickness of metallic and dielectric layers such as those found when gaps are formed during the application of such layers. Again, these prior art difficulties arise due to the inability to properly control the polishing pressure applied to the wafer surface due to the lack of cushioning of the polishing pad. Consequently, these problems arise due to the fact that the prior art polishing belt designs do not properly control polishing dynamics because of the lack of cushioning in the polishing pad.

Therefore, there is a need for a method and an apparatus that overcomes the problems of the prior art by having a polishing pad structure that is longer lasting that further enables more consistent and effective polishing in a CMP process.

SUMMARY OF THE INVENTION

Broadly speaking, the present invention fills these needs by providing an improved method of making a polishing pad structure and an apparatus using the same for polishing a wafer during a chemical mechanical polishing (CMP) process. The method involves generating a new, more efficient, improved CMP pad and belt structure which is more resistant to degradation and more effectively polishes wafers. It should be appreciated that the present invention can be implemented in numerous ways, including as a process, an apparatus, a system, a device or a method. Several inventive embodiments of the present invention are described below.

In one embodiment, a seamless polishing apparatus for utilization in chemical mechanical polishing is provided. The seamless polishing apparatus includes a polishing pad where the polishing pad is shaped like a belt and has no seams. The seamless polishing apparatus also includes a base belt where the base belt includes a reinforcement layer and a cushioning layer. The cushioning layer is an intermediary layer between the polishing belt pad and the base belt.

In another embodiment, a seamless polishing apparatus for utilization in chemical mechanical polishing is provided. In this embodiment, the seamless polishing apparatus includes a polishing pad where the polishing pad is shaped like a belt and has no seams. The seamless polishing apparatus also includes a base belt where the base belt includes a reinforcement layer and a cushioning layer. In this embodiment, the reinforcement layer is a steel layer. The cushioning layer is an intermediary layer between the continuous pad and the reinforcement layer.

In yet another embodiment, a polishing structure for utilization in chemical mechanical polishing is disclosed. The polishing structure includes a polishing pad where the polishing pad is shaped like a belt and is a contiguous unit. The polishing pad is made of a polymeric material. The polishing structure also includes a base belt where the base belt includes a reinforcement layer and a cushioning layer. In this embodiment, the reinforcement layer is a steel layer and the cushioning layer is an intermediary layer between the polishing pad and the reinforcement layer. Furthermore, the cushioning layer is a polymeric material.

In another embodiment, a seamless polishing apparatus for utilization in chemical mechanical polishing is disclosed. The seamless polishing apparatus includes a polishing pad where the polishing pad is shaped like a belt and is a contiguous unit and has grooves on a pad surface and the polishing pad is made up of polyurethane. The seamless polishing apparatus also has a base belt where the base belt includes a reinforcement layer and a cushioning layer where the reinforcement layer and the cushioning layer is attached by way of a first adhesive film, and the base belt and the polishing pad are attached by way of a second adhesive film. In this embodiment, the reinforcement layer is a steel layer. The cushioning layer is an intermediary between the polishing pad and the reinforcement layer where the cushioning layer is a polyurethane material.

In yet another embodiment, a seamless polishing apparatus for utilization in chemical mechanical polishing is disclosed. The seamless polishing apparatus includes a polishing pad where the polishing pad is shaped like a belt and configured to a contiguous unit. The seamless polishing apparatus also includes a base belt that has a reinforcement layer and a cushioning layer. Also included in the seamless polishing apparatus is a cap covering an adhesive film between the base belt and the polishing pad. The cushioning layer is an intermediary between the continuous pad and the base belt.

In another embodiment, a seamless polishing apparatus for utilization in chemical mechanical polishing is disclosed.

The seamless polishing apparatus includes a polishing pad where the polishing pad is shaped like a belt and has no seams. The polishing pad also is made up of a polymeric material where the polishing pad has a grooved top surface and is between about 30 mils and 100 mils in thickness. The seamless polishing apparatus also includes a base belt that has a reinforcement layer and a cushioning layer where the cushioning layer is between about 10 mils and about 100 mils in thickness. The reinforcement layer is between about 5 mils and 50 mils in thickness. The cushioning layer is an intermediary between the continuous pad and the base belt.

In yet another embodiment, a method for generating a polishing pad structure for utilization in chemical mechanical polishing is disclosed. First, a reinforcement layer is provided. Then a first adhesive film is applied over the reinforcement layer. Afterward, a cushioning layer is attached on the first adhesive film. Thereafter, a second adhesive film is applied over the cushioning layer. Then a seamless polishing pad is attached on the second adhesive film. Furthermore, the polishing pad structure is cured.

In another embodiment, a method for generating a polishing pad structure for utilization in chemical mechanical polishing is disclosed. First, a reinforcement layer is provided. Then a first adhesive film is applied over the reinforcement layer. Afterward, a cushioning layer is attached on the first adhesive film. Thereafter, a second adhesive film is applied over the cushioning layer. Then a seamless polishing pad is attached on the second adhesive film where the seamless polishing pad has a grooved top surface. Furthermore, the polishing pad structure is cured between about 12 hours and 48 hours at a temperature of between about 150 F to about 300 F.

In yet another embodiment, a method for generating a polishing pad structure for utilization in chemical mechanical polishing is disclosed. First, a reinforcement layer is provided. Then a first adhesive film is applied over the reinforcement layer. Afterward, a cushioning layer is attached on the first adhesive film. Thereafter, a second adhesive film is applied over the cushioning layer. Then a seamless polishing pad is attached on the second adhesive film where the seamless polishing pad has a grooved top surface, and the seamless polishing pad is generated by pouring a polymeric gel into a mold. Furthermore, the polishing pad structure is cured for about 20 hours in a temperature of about 200 F.

The advantages of the present invention are numerous. Most notably, by constructing a polishing pad and supporting structure in accordance with any one of the embodiments of the present invention, the polishing pad and supporting structure will be able to provide more efficient and effective polishing operations over wafer surfaces (e.g., metal and oxide surfaces). Furthermore, because the wafers placed through a CMP operation using the improved polishing pad are polished with better repeatability and more consistency, the CMP operation will also result in improved wafer yields. The polishing structure of the present invention may be strongly held together by dynamically cured adhesives and/or fusing. Therefore the polishing structure may resist shearing forces much better than the prior art thus greatly decreasing the possibility of polishing pad delamination. In addition, because the polishing pad does not have seams, it will be more resistant to delamination than the prior art. Still further, due to the increased resistance to delamination, the polishing pad of the present invention lasts longer and may have to be changed much less frequently. Consequently, due to the substantial increase in the polishing pad life, the CMP operations have to be stopped less frequently to change the polishing pad. Because of the time often necessary to change polishing pads in prior art belt polishing systems, the significantly more durable polishing pad structure of the present invention may result in a significantly increased wafer production. Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

Figure 1A:
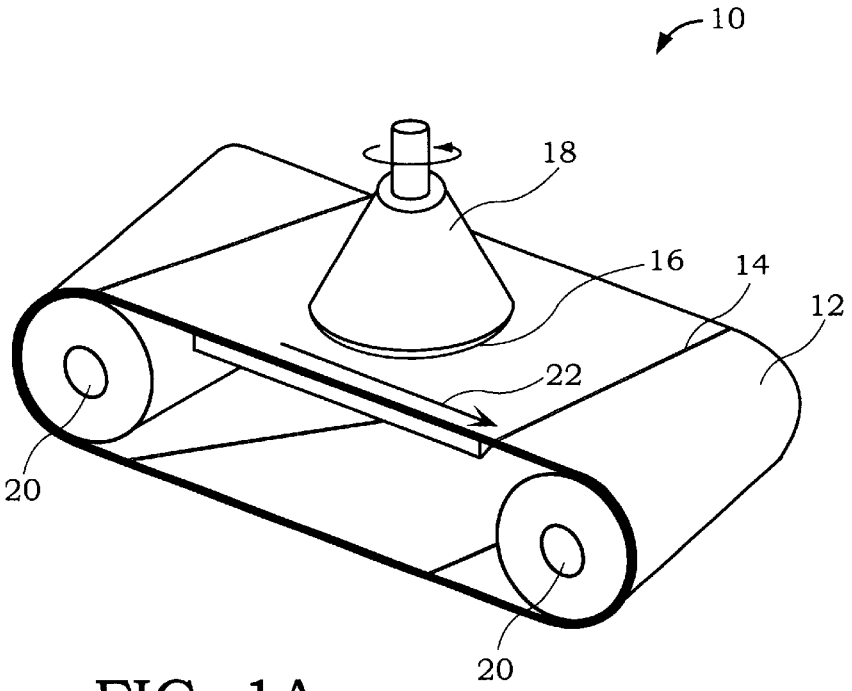
FIG. 1A (Prior Art)
FIG. 1A shows a linear polishing apparatus which is typically utilized in a CMP system.
Figure 1B:
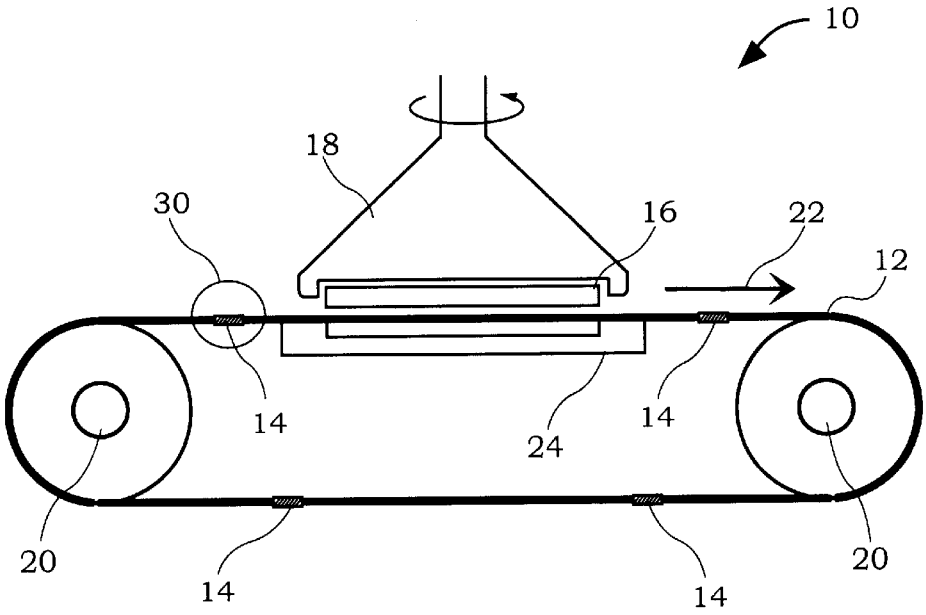
FIG. 1B (Prior Art)
FIG. 1B shows a side view of the linear polishing apparatus.
Figure 1C:
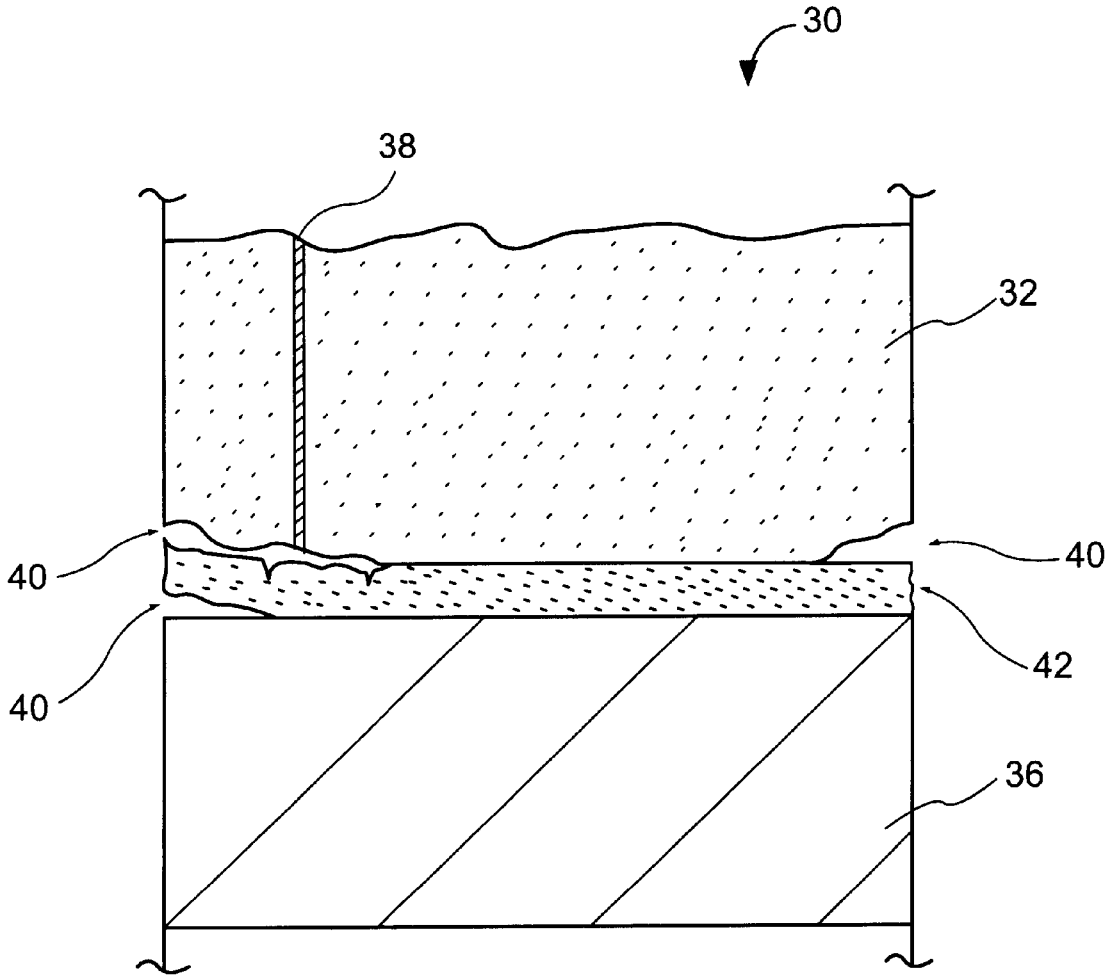
FIG. 1C (Prior Art)
FIG. 1C shows a magnified view of an exemplary seam section after delamination has started to take place.

An invention for a method of making a polishing pad structure and an apparatus using the same is disclosed. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

In general terms, the present invention is directed toward a polishing pad structure and method for making the structure. The polishing pad structure includes a supporting layer, a cushioning layer, and a pad layer. In a preferred embodiment, the pad layer is designed and made as a contiguous and seamless unit and is preferably adhered to the cushioning layer to enable more consistent and effective wafer polishing during CMP operations. The pad layer, being a contiguous and seamless unit also provides for a longer lasting pad structure that is substantially more resistant to delamination.

As described herein, a polishing pad structure may include a polishing pad (or pad layer) in addition to any other layer that may utilized in conjunction with the polishing pad such as, for example, the cushioning layer, the support layer, a reinforcement layer, a polymeric precursor layer, a polymeric precursor, a liquid polymeric precursor layer, etc. In a preferred embodiment, the support layer is a stainless steel belt. The polishing pad within a polishing pad structure may be in either a generic pad form, a belt form, or any other form that may be utilized in a CMP process. The polishing pad may also be referred to as a seamless polymeric polishing pad, a seamless polymeric polishing belt, polymeric polishing pad, a linear belt polymeric polishing pad, polymeric polishing belt, a polishing layer, a polishing belt or any other term that could describe the present invention. Furthermore, the polishing pad structure of the present invention may be utilized in any type of operation which may require controlled, efficient, and accurate polishing of any surface of any type of material. One embodiment of the polishing pad structure as described below includes two basic structural components: a seamless polymeric polishing pad, and a base belt. The base belt, as used herein includes at least one cushioning layer, and a reinforcement layer such as the aforementioned stainless steel belt. The seamless polymeric polishing pad is attached to the base belt by an adhesive film. By using a seamless polishing pad, the risk of moisture induced weaknesses and the resulting delamination prevalent in the prior art may be reduced thus increasing polishing pad life. In addition, the base belt increases wafer polishing effectiveness. Therefore, the apparatus and method of polishing wafers optimizes CMP effectiveness and increases wafer processing throughput by way of an apparatus with a seamless polymeric polishing pad and a unique combination of a reinforcement layer and a cushioning layer.

Figure 2A:
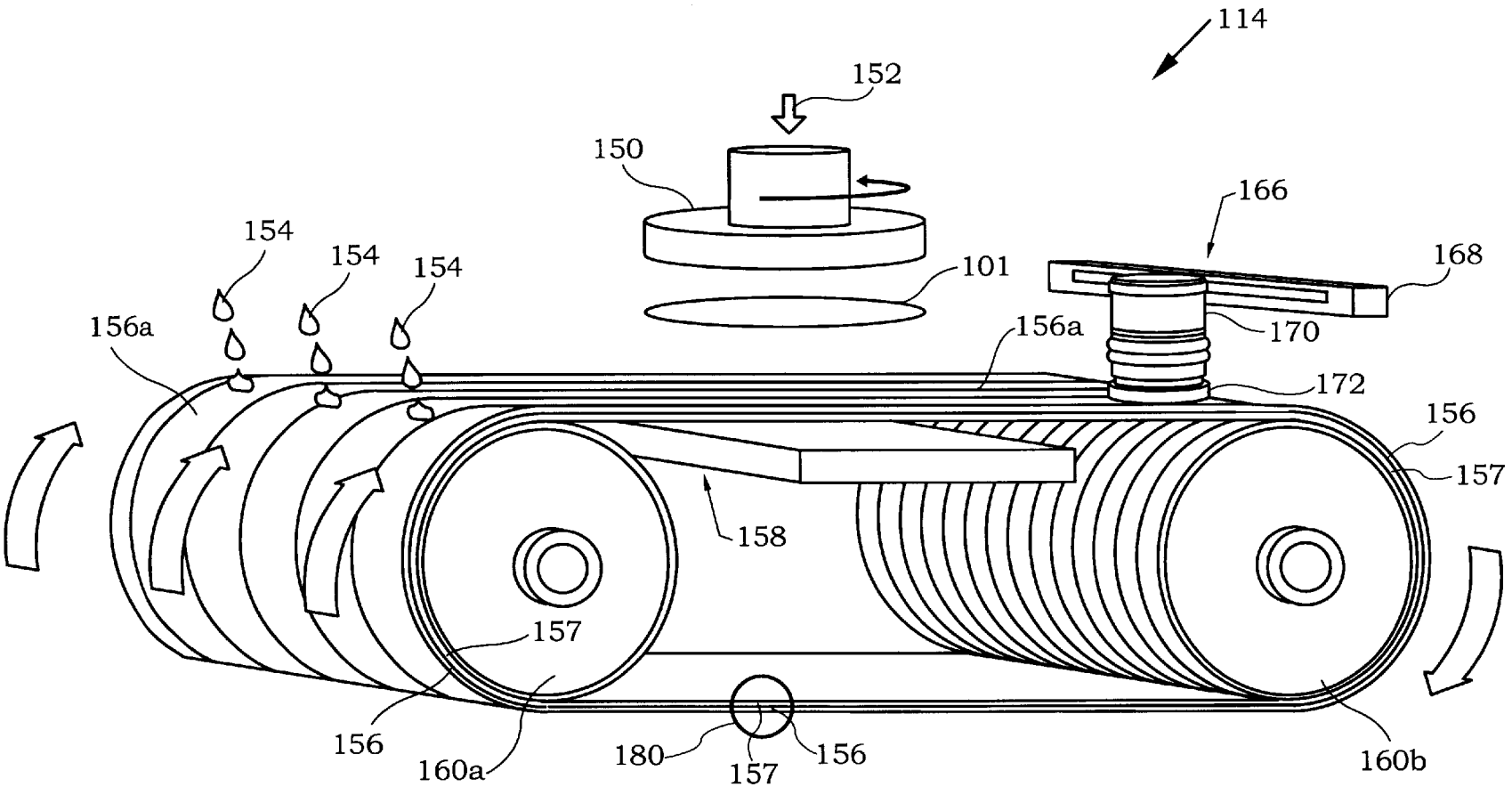
FIG. 2A shows a side view of a CMP system according to one embodiment of the present invention.

FIG. 2A shows a side view of a CMP system 114 according to one embodiment of the present invention. A polishing head 150 may be used to secure and hold the wafer 101 in place during processing. A polymeric polishing pad 156 (also referred to as a seamless polymeric polishing belt or a polymeric polishing belt) is preferably secured to a base belt 157, which forms a continuous loop around rotating drums 160*a* and 160*b*. The polymeric polishing pad 156 may be secured to the base belt 157 by using a well-known glue or other adhesive material. In another embodiment, the polymeric polishing pad 156 may be secured to the base belt 157 through a direct casting of polyurethane on top of the base belt 157. This process is discussed further in reference to FIGS. 2C and 5B. The polymeric polishing pad 156 itself is preferably made of a polymeric material. A polishing section 180 including the polymeric polishing pad 156 and the base belt 157 is discussed in further detail in reference to FIG. 2B.

The polymeric polishing pad 156 generally rotates in a direction indicated by the arrows at a speed of about 400 feet per minute. Although, this speed does vary depending upon the specific CMP operation. As the belt rotates, polishing slurry 154 may be applied and spread over the surface 156*a* of the polymeric polishing pad 156. The polishing head 150 may then be used to lower the wafer 101 onto the surface 156*a* of the rotating polymeric polishing pad 156. In this manner, the surface of the wafer 101 that is desired to be planarized is substantially smoothed.

In some cases, the CMP operation is used to planarize materials such as copper (or other metals), and in other cases, it may be used to remove layers of dielectric or combinations of dielectric and copper. The rate of planarization may be changed by adjusting the polishing pressure 152. The polishing rate is generally proportional to the amount of polishing pressure 152 applied to the polymeric polishing pad 156 against the polishing pad stabilizer 158. The polishing pad stabilizer 158 may also be referred to as a platen. In one embodiment, the polishing pad stabilizer may use an air bearing. It should be understood that the polishing pad stabilizer 158 may utilize any type of bearing such as, for example, a fluid bearing, etc. After the desired amount of material is removed from the surface of the wafer 101, the polishing head 150 may be used to raise the wafer 101 off of the polymeric polishing pad 156. The wafer is then ready to proceed to a wafer cleaning system.

In one embodiment, the CMP system 114 can be improved for the next wafer by conditioning the surface of the polymeric polishing pad 156. Conditioning of the pad may be performed by removing excess slurry and residue build-up from the clogged belt pad. As more wafers are planarized, the belt pad will collect more residue build-up which can make efficient CMP operations difficult. One method of conditioning the belt pad is to use a polishing pad conditioning system 166. A conditioning head 170 is preferably used to hold (and in some embodiments rotate) a conditioning disk 172 as a conditioning track 168 holds the conditioning head 170. The conditioning track 168 moves the conditioning head 170 back and forth as the conditioning disk 172 scrapes the polishing pad 156, preferably with a nickel-plated diamond conditioning disk.

In one embodiment, the polymeric polishing pad 156 is a one piece polishing belt without any seams. In another embodiment, the polymeric polishing pad is shaped like a belt and is a contiguous unit. By use of the one piece polishing belt, seams which can allow moisture to intrude into an adhesive film do not exist. Therefore, the present invention may dramatically increase the life of the polymeric polishing pad 156. As discussed further below in reference to FIG. 2B, the base belt 157 includes a reinforcement layer and a cushioning layer. By use of a dual layer base belt, the dynamics of the polishing by the polymeric polishing pad 156 may be controlled in a more precise and prescribed manner.

Figure 2B:
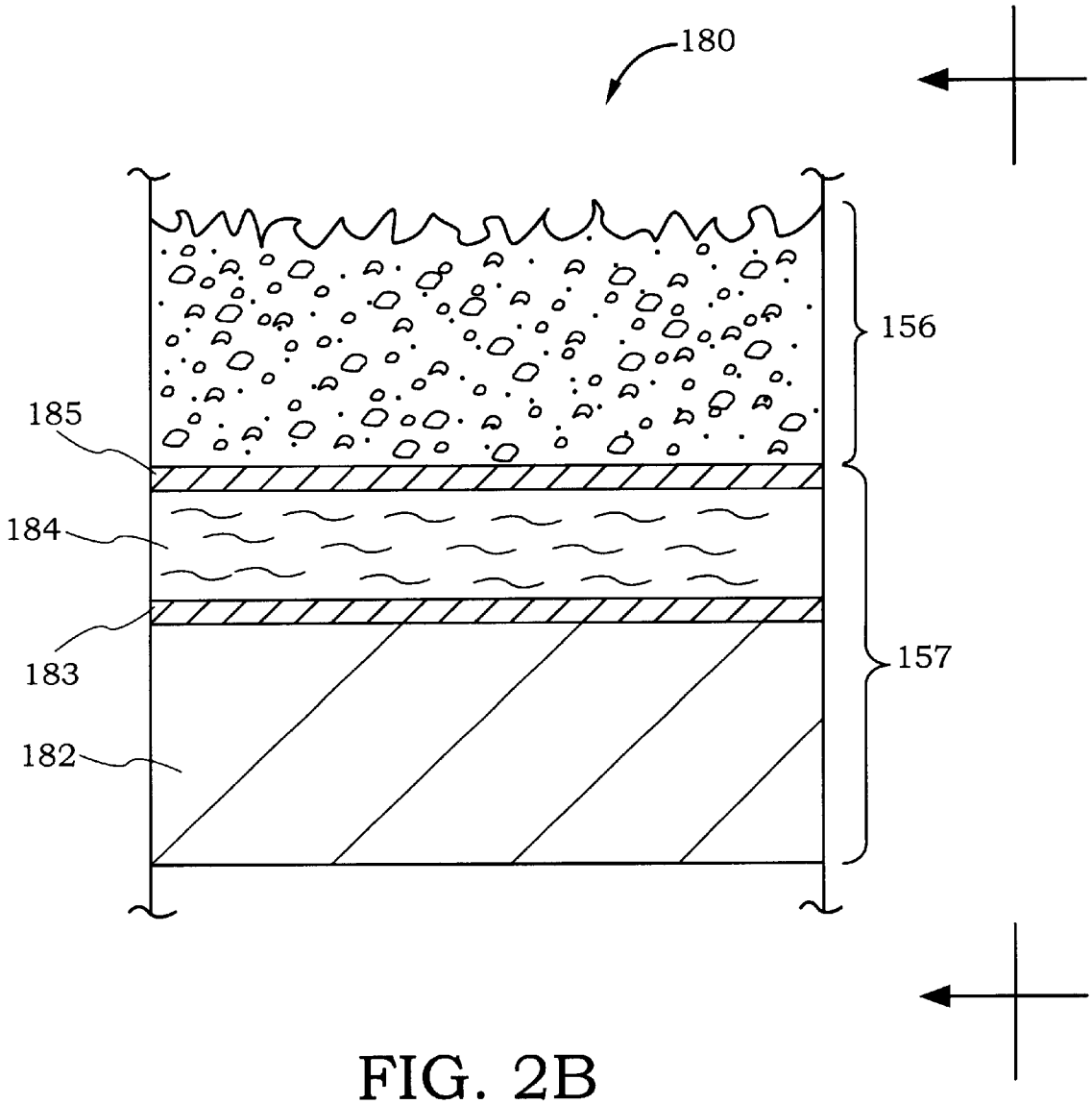
FIG. 2B shows a polishing section in accordance with one embodiment of the present invention.

FIG. 2B shows a polishing section 180 in accordance with one embodiment of the present invention. It should be understood that the polishing section 180 of the present invention may include any number of layers or belts composed of any type of material or materials as long as a resulting polishing belt structure accurately polishes wafers and resists delamination and deformation. In one embodiment, polishing section 180 includes a polymeric polishing pad 156 attached to a base belt 157 by way of an adhesive film 185. The polymeric polishing pad 156 may be any type of seamless polishing pad made out of any type of material such as, for example, polymers. In one embodiment, the polymeric polishing pad 156 is made out of a polymeric polishing material such as one described in a U.S. patent application Ser. No. 09/596,842 entitled "Improved Polishing Pad with Reduced Moisture Absorption," which is incorporated herein by reference.

It should be understood that the polymeric polishing pad 156 may be any thickness which would allow even, effective, and consistent polishing of the wafer in the dynamics desired. In one embodiment, the polishing pad 156 is between about 30 mils (a mil equals $1\times10^{-3}$ inch) and about 100 mils in thickness. In another embodiment the polishing pad 156 is about 40 mils in thickness.

In one embodiment, the polymeric polishing pad 156 does not have any seams and is a one-piece material. Therefore the polishing section 180 of the present invention resists moisture from, for example, slurries. It should be understood that the present invention may resist moisture from any source such as for example, chemicals, water, etc. In the prior art polishing belts, moisture could enter polishing structures through seams to adhesive areas and break down or dissolve adhesive films between the polishing belt and an underlying layer and therefore causing delamination. This undesirable characteristic decreased prior art polishing belt life. In contrast, because of the intelligent and effective polishing structure, the present invention may resist delamination and last longer than prior art apparatuses.

In addition, the polymeric polishing pad 156 also resists shearing much better than the prior art due to the seamless design. When the polymeric polishing pad 156 and the base belt 157 moves over the rotating drums 160*a* and 160*b*, the bending generated by this action creates stretching forces on both the polymeric polishing pad 156 and the base belt 157. Then when the polymeric polishing pad 156 and the base belt 157 straightens out again after moving off of the rotating drums 160*a* and 160*b*, compressing forces are generated. The stretching and the compressing as described imposes shearing forces on the polymeric polishing pad 156 and the base belt 157. Fortunately, the present invention resists the shearing forces that may cause delamination due to its unique structure (as discussed below in reference to FIGS. 2B, 2C, 3A, 3B, 4, 5A, 5B). Consequently, the present invention may significantly longer life and may be used to polish more wafers before the pad must be changed. It is believed that the embodiments of the present invention will enable consistent polishing up to about 3000 wafer or more before the polishing section 180 needs to be replaced.

The base belt 157 is composed of two separate layers including a cushioning layer 184 attached onto a reinforcement layer 182 by an adhesive film 183. It should be appreciated that the adhesive film 183 may be any thickness as long as a strong bond is created between the cushioning layer 184 and the reinforcement layer 182. In one embodiment, the adhesive is 8 mils thick. Generally, any adhesive that provides good bonding can be used. Examples include, 3M 442 tape, 3M467MP, 3M447, a rubber-based adhesive, etc. In one embodiment, a permanent rubber-based adhesive may be utilized as the adhesive.

It should be appreciated that the cushioning layer 184 may be made out of any type of material as long as the cushioning properties are such that allows effective wafer polishing such as, for example, an open celled polyurethane material, etc. In one embodiment, the cushioning layer 184 has sponge-like properties. In another embodiment, the cushioning layer 184 may be a TW-817 cushioning layer made by Thomas West, Inc. of California. In yet another embodiment, the cushion layer 184 may be a Suba IV cushioning layer made by Rodel, Inc.

It should be understood that the cushioning layer 184 and the reinforcement layer 182 may be any thickness which optimizes the polishing of wafers. In one embodiment, the cushioning layer 184 is between about 10 mils and about 100 mils thick. In another embodiment, the cushioning layer 184 is about 20 mils thick. In one embodiment, the reinforcement layer 182 is between about 5 mils and about 50 mils thick. In another embodiment, the reinforcement layer 182 is about 20 mils thick.

Through the use of the reinforcement layer 182, the base belt 157 may provide a strong support structure so that the polymeric polishing pad 156 does not bend or give way easily. It should be appreciated that any type of material may be utilized as the reinforcement layer 182 which is sufficiently rigid such as, for example, steel, Kevlar™, etc. In one embodiment, the reinforcement layer 182 is made out of stainless steel. In addition, the use of a strong support structure of the reinforcement layer 182 in conjunction with the cushioning layer 184 enables better control of the polishing process and may result in increased wafer polishing accuracy and consistency. By use of such a multi-layer polymeric pad structure, the polishing section 180 may be constructed in such a way that resists degradation and enables more wafer polishing throughput in the polishing of wafers. Additionally, the significant increase in polishing pad life may decrease overall wafer production costs due to the greater wafer polishing throughput.

Figure 2C:
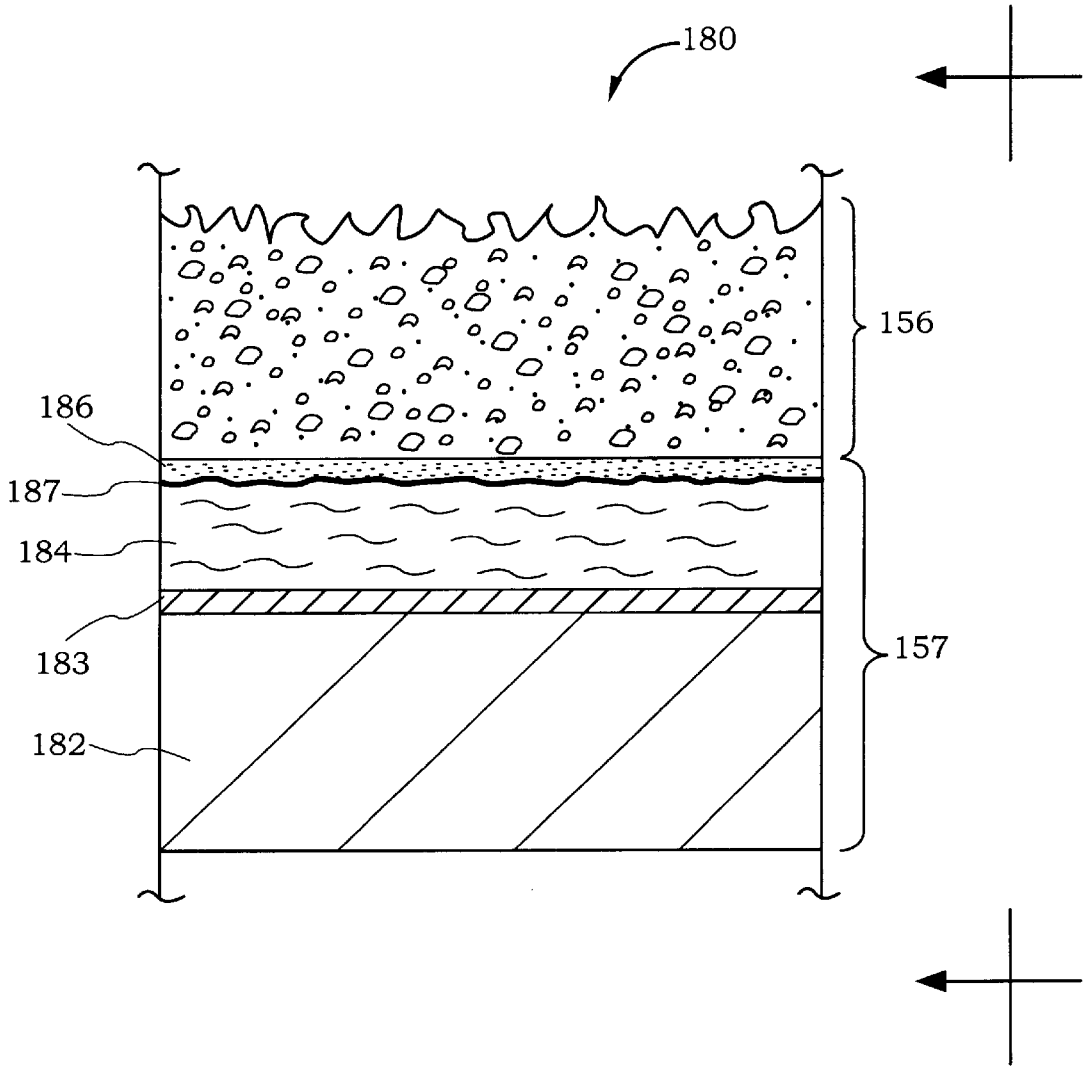
FIG. 2C illustrates a cross sectional view of a polishing section showing a polymeric polishing pad fuised to a base belt in accordance with one embodiment of the present invention.

FIG. 2C illustrates a cross sectional view of a polishing section 180 showing a polymeric polishing pad 156 fused to a base belt 157 in accordance with one embodiment of the present invention. The polishing section 180 includes the polymeric polishing pad 156 connected to the base belt 157. The base belt 157 has a cushioning layer 184 attached to a reinforcement layer 182 by an adhesive film 183.

In one embodiment, the polymeric polishing pad 156 is fused to the base belt 157. The fusing occurs when a polymeric material is directly casted onto a top surface 186 of the cushioning layer 184 of the base belt 157. Fusing may be generated through the use of a direct casting process, which in general is an application of a polymeric precursor (usually in a liquid or a semi-solid form) of a polishing pad to a surface. It should be appreciated that the polymeric precursor may be any type of material which may form an effective polishing pad. The polymeric precursor later solidifies into a polymeric polishing pad. In one embodiment, during a direct casting process, a polishing pad precursor such as, for example, a liquefied (or semi-solid) polymer is applied to the top surface 186 of the cushioning layer 184. In one embodiment, the polishing pad precursor is a liquefied polyurethane. During this process, the liquefied polymer flows into a pore structure of the cushioning layer 184. It should be appreciated that the liquefied polymer may penetrate to any depth in the cushioning layer 184 to enable the polymeric polishing pad 156 and the cushioning layer 184 of the base belt 157 to form a cohesive unit.

In another embodiment, the liquefied polymer flows to a depth of about 21 mils underneath the top surface 186 of the cushioning layer 184. The extent of the depth of liquefied polymer flow into the cushioning layer 184 is shown as border 187. The section between the border 187 and the top surface 186 is a fused portion where the polymeric material (resulting from the solidification of the liquid polymer) of the polymeric polishing pad 156 fuses (or attaches) with the cushioning layer 184. In this embodiment, because of the excellent cohesion produced by the fusing, adhesives are not used to attach the polishing pad 156 to the base belt 157.

Figure 3A:
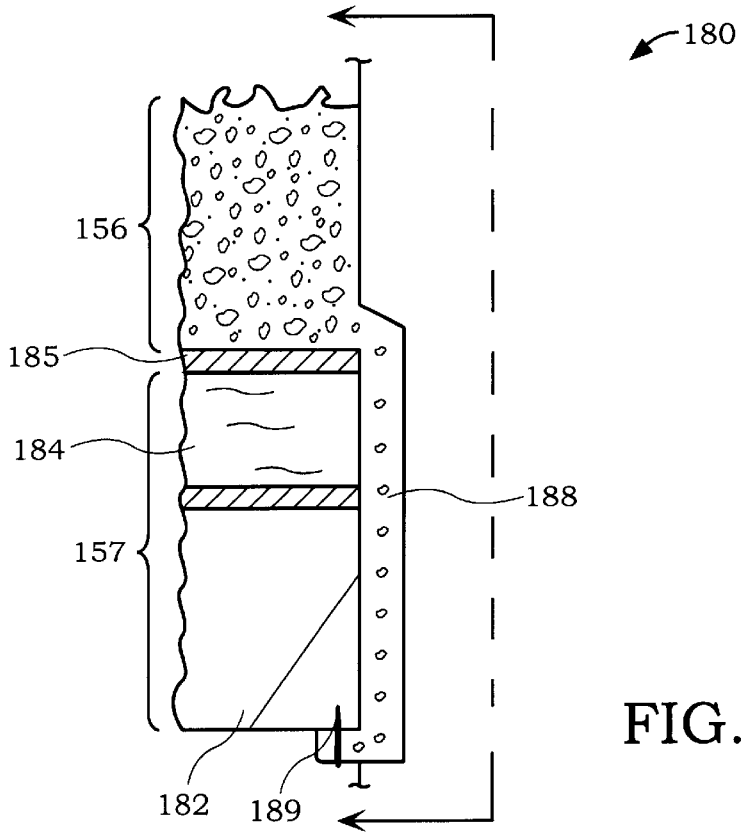
FIG. 3A shows a cross sectional view of a polishing section capped by a polymeric flap in accordance with one embodiment of the present invention.

The cohesion produced by the fusing is strengthened through the use of curing where the polymeric polishing pad 156 and the base belt 157 are cured. In one embodiment, the curing takes place for about 18 hours at a temperature of about 212 F (F as referred to herein is degrees Fahrenheit). It should be understood that any type of curing process (for any amount of time at any temperature) may be utilized where a cohesive bond may be created or strengthened between the polymeric polishing pad 156 and the base belt 157. In addition, fusing the layers allows for attaching of the polymeric polishing pad directly to the cushioning pad thus avoiding usage of an adhesive film. Consequently, this type of fusing may enable the polishing structure of the present invention to resist both moisture and shear stresses resulting in a greatly reduced chance of delamination taking place between the polymeric polishing pad 156 and the base belt 157. FIG. 3A shows a cross sectional view of a polishing section 180 capped by a polymeric flap 188 in accordance with one embodiment of the present invention. It should be understood that the polishing section 180 of this embodiment may be utilized within the CMP system 114 as described in reference to FIG. 2A. In one embodiment, the polishing section 180 has a polymeric polishing pad 156 over a base belt 157. As discussed above in reference to FIG. 2B, the base belt 157 includes a cushioning layer 184 attached on top of a reinforcement layer 182 by use of an adhesive film 183. In addition, the polymeric polishing pad 156 is attached on top of the cushioning layer 184 by adhesive 185. In one embodiment, in addition to the polymeric polishing pad 156, the polishing section 180 has a polymeric flap 188 that covers the base belt 157. The polymeric polishing layer flap 188 is attached to the base belt 157 by a pin 189 that is inserted into reinforcement layer 182 within the base belt 157. The polymeric polishing layer flap 188 may also be called a cap. It should be understood that any way of reducing moisture seepage into layers below a polymeric polishing layer may be utilized such as, for example, sealing the sides of the polymeric polishing layer with a polymeric sealant, etc.

Figure 3B:
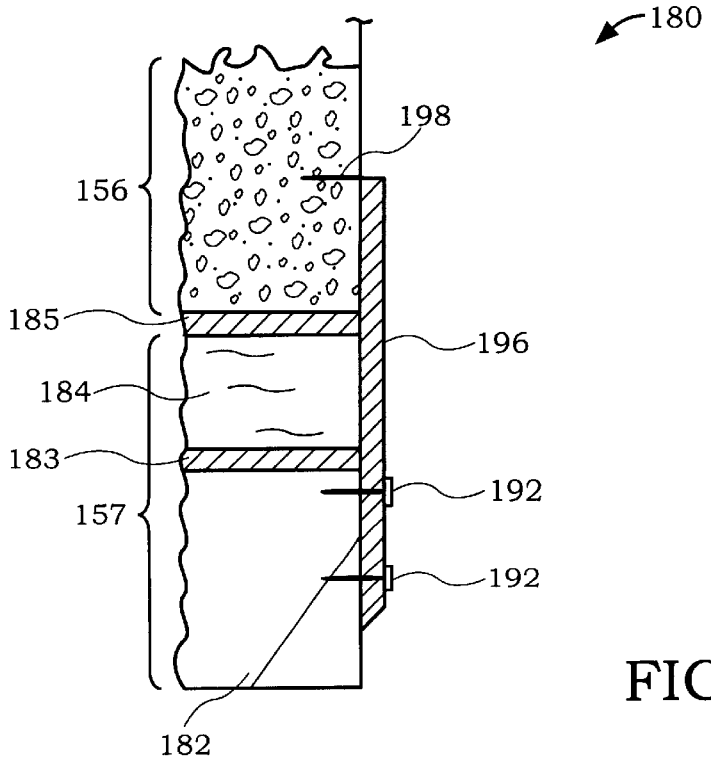
FIG. 3B shows a cross sectional view of a polishing section capped by a cover in accordance with one embodiment of the present invention.

FIG. 3B shows a cross sectional view of a polishing section 180 capped by a cover 196 in accordance with one embodiment of the present invention. In this embodiment, the polishing section 180 has a polymeric polishing pad 156 attached over a base belt 157 by use of an adhesive 185. The base belt 157 includes a cushioning layer 184 attached on top of a reinforcement layer 182 by use of an adhesive film 183. The polishing section 180 has a cover 196 protecting the adhesive films 185 and 183. The cover 196 is connected on one end to the polymeric polishing pad 156 by a pin 198 and connected on the other end by pins 192.

By use of the cover 196, the adhesive films 183 and 185 may be protected from side moisture intrusion by, for example, liquid from a slurry. It should be appreciated that the cover 196 may be any type of material as long as the material resists moisture intrusion. The cover may also be known as a cap. In one embodiment, the cover 196 is made from a polymeric material such as, for example, polyurethane. It should be understood that the cover 196 may protect the adhesive films 183 and 185 from any type of liquid like substance. Therefore, the adhesive films 183 and 185 may remain intact and resist moisture induced adhesive degradation from the side of the polishing section 180. In addition, in one embodiment, the polymeric polishing pad 156 is seamless so moisture seepage is reduced from the top section of the polymeric polishing pad 156. It should be understood that any way of reducing moisture seepage may be utilized and that other ways to do so may be employed besides utilization of the flap 188 (as shown in FIG. 3A) or the cover 196. For example, the entire polishing structure may be coated with a polymeric material, or a sealant. Therefore, any way of sealing off moisture vulnerable sections of the polishing structure may be effective. As a result, the polishing section 180 may resist moisture intrusion better and therefore last longer and may be utilized to polish many more wafers than polishing belts of the prior art.

Figure 4:
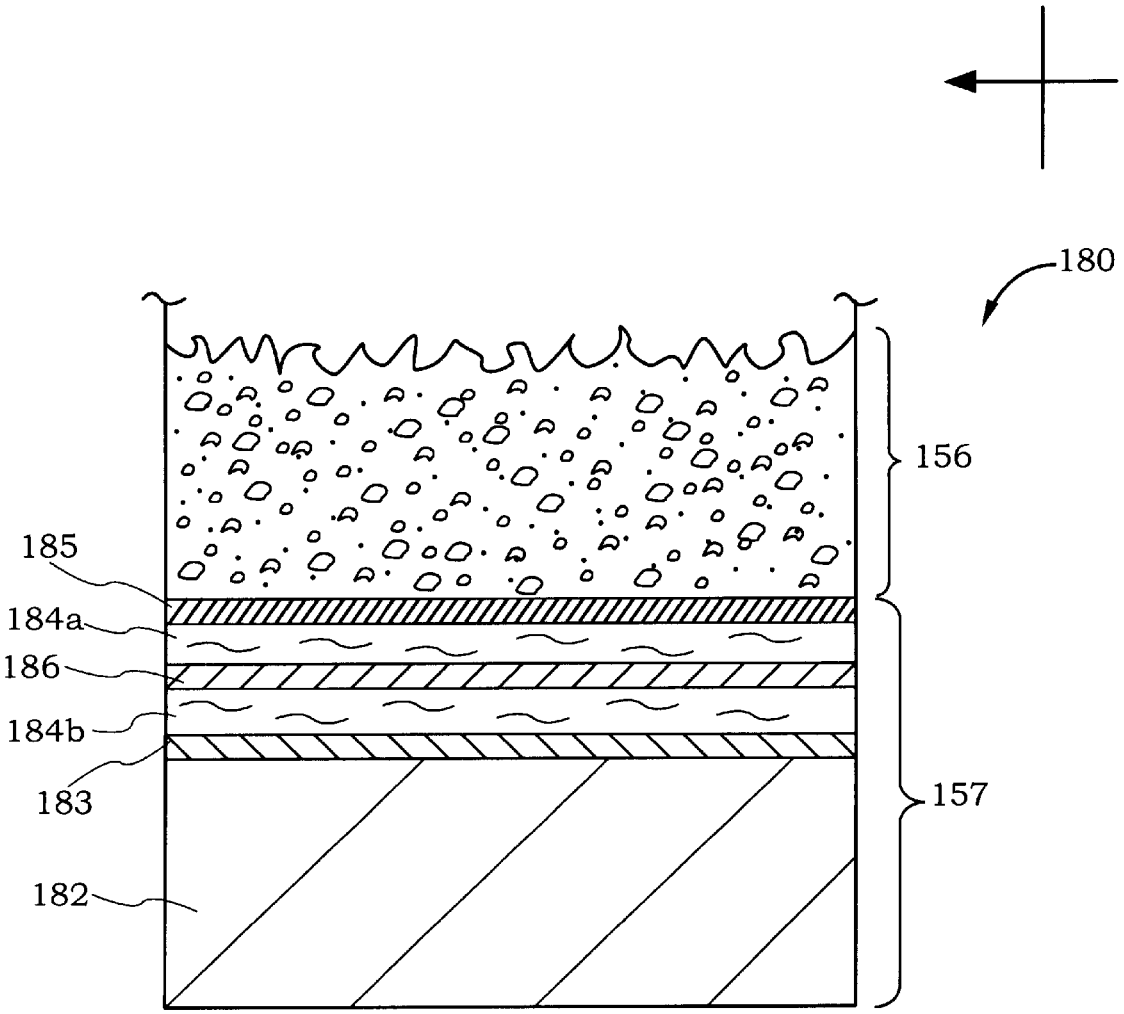
FIG. 4 is a cross sectional view of a polishing section in accordance with one embodiment of the present invention.

FIG. 4 is a cross sectional view of a polishing section 180 in accordance with one embodiment of the present invention. In this embodiment, a polymeric polishing pad 156 is attached by an adhesive film 185 to the top of a base belt 157. The base belt 157 has three distinct layers including a cushioning layer 184*a* and a cushioning layer 184*b* connected to a reinforcement layer 182. The cushioning layer 184*a* and the cushioning layer 184*b* are connected by an adhesive file 186 while the cushioning layer 184*b* is attached by adhesive film 183 to the reinforcement layer 182.

The cushioning layer 184*a* may be either softer or harder than the cushioning layer 184*b* depending on the desires of polishing dynamics. In one embodiment, the cushioning layer 184*a* may be one made by Thomas West, Inc. In another embodiment, the cushioning layer 184*a* is softer than the cushioning layer 184*b*. This configuration allows a gradual hardening of the polishing section 180 from top to bottom to enable better conformation to a wafer surface by the polymeric polishing pad 156. In yet another embodiment, the cushioning layer 184*a* may be rigid and the cushioning layer 184*b* may be soft. The cushioning layer 184*a* may then increase the tension of the polymeric polishing pad 156. This may be desirable to keep the cushioning layer 184*a* encapsulated in case of failure (e.g., delamination) of the polishing section 180. As can be appreciated, the polishing section 180 may have numerous cushioning layers with different pliancy characteristics to powerfully customize a CMP process. In one embodiment, the cushioning layers 184*a* and 184*b* may be made from the same material, and in another embodiment the cushioning layers 184*a* and 184*b* may be made from different materials. In yet another embodiment, the cushioning layers 184*a* and 184*b* may be made from any type of cushioning or rigid layer such as, for example, polymeric material, polyurethane, Suba IV made by Rodel Inc., TW-817 made by Thomas West Corporation of California, stainless steel, Kevlar™, etc.

In another embodiment, a different type of polishing material may be used, such as, for example, a fixed abrasive material, on top of the polymeric polishing pad 156. In such an embodiment, the polymeric polishing pad 156 may act as the support layer to the fixed abrasive material.

Figure 5A:
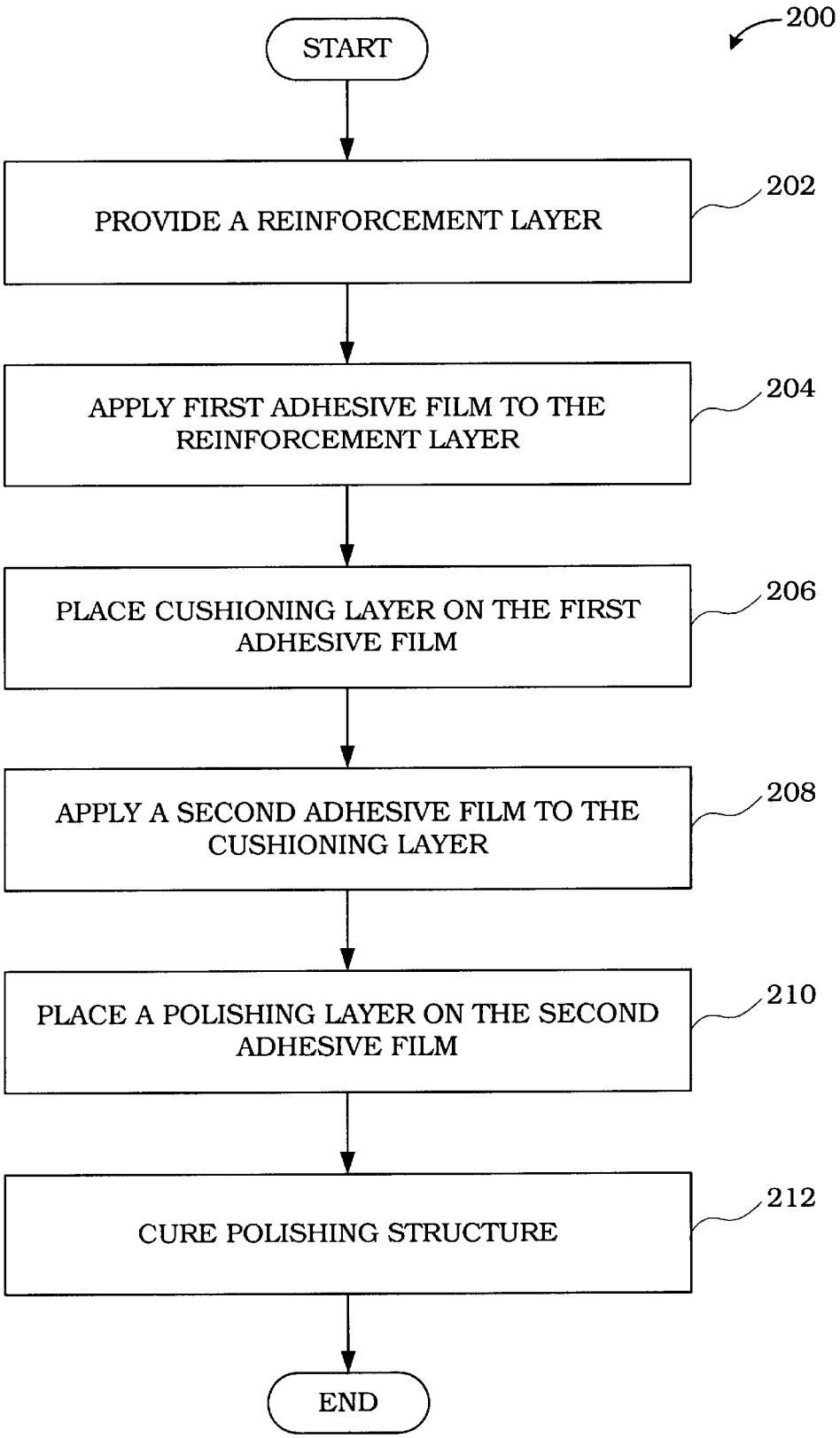
FIG. 5A shows a flowchart defining a method for generating a seamless polymeric polishing pad attached to a base belt in accordance with one embodiment of the present invention.

FIG. 5A shows a flowchart 200 defining a method for generating a seamless polymeric polishing pad attached to a base belt in accordance with one embodiment of the present invention. In operation 202, the method begins with providing a reinforcement layer. In one embodiment, a reinforcement layer such as, for example, stainless steel is utilized so a polishing pad may be properly supported and therefore evenly polish a wafer. Oftentimes, without a reinforcement layer, the polishing pad can deform under the pressure of the wafer and therefore not polish the wafer properly. It should be appreciated that any number of materials or metals may be utilized in the reinforcement layer such as, for example, Kevlar™, etc. In one embodiment, the reinforcement layer is in the form of a stainless steel belt to accommodate the shape of a polishing pad in the shape of a belt.

After operation 202, the method progresses to operation 204 where a first adhesive film is applied to the reinforcement layer. It should be understood that any type of adhesive may be utilized in this operation such as, for example, 3M 442 tape, rubber based adhesive, etc. In one embodiment, an adhesive is applied in a thin film over the reinforcement layer so a next layer may be attached. In another embodiment, a permanent rubber-based adhesive may be utilized for its flowing characteristics when cured as described below.

Then the method moves to operation 206 where a cushioning layer is placed on the first adhesive film. It should be understood that any type of cushioning layer made from any type of material may be utilized in this operation. In one embodiment, the cushioning layer may be made of a type of polymer, such as, for example, polyurethane. In another embodiment, the cushioning layer may be a belt which can fit over a reinforcement belt. Any cushioning layer thickness may be utilized as long as the resulting cushioning properties of the material is compatible with the polishing characteristics desired.

After operation 206, the method advances to operation 208 where a second adhesive film is applied to the cushioning layer. The second adhesive film is necessary so a polishing pad may be attached to the base belt (which includes the reinforcement layer and the cushioning layer). It should be appreciated that like the first adhesive film, any type of adhesive may be utilized such as, for example, a water resistant adhesive, etc.

Then, operation 210 places a polishing pad on the second adhesive film. In one embodiment, the polishing pad is a polymeric polishing shaped like a belt and has no seams. In another embodiment, the polishing pad is shaped like a belt and may be a contiguous unit. It should be appreciated that any type of polishing pad made out of any type of material in any type of shape may be utilized in this operation as long as the material can polish the wafer in an effective manner.

After operation 210, the method moves to operation 212 where a polishing structure is cured. It should be understood that the polishing structure may refer to any type of structure that includes any type of polishing pad (including polishing pad precursors such as, for example, polymeric precursors) and any type of base belt. In one embodiment, the polishing structure includes a polymeric polishing pad, a cushioning layer, and a reinforcement layer all attached through adhesives as disclosed in operations 202, 204, 206, 208, and 210. The curing process includes heating the polishing structure at a certain temperature for a certain period of time. It should be understood that the polishing structure may be heated at any temperature for any length of time as long as the polishing structure's cohesiveness is enhanced. In one embodiment, the polishing structure is heated for about 20 hours at a temperature of about 200 F (F refers to degrees Fahrenheit). In another embodiment, when a permanent rubber based adhesive is utilized, the adhesive softens and flows during the curing and therefore increases the contacting surface area between the rubber adhesive and the cushioning layer thus increasing adhesive strength by a factor of 4.

By utilizing the seamless polymeric polishing pad, the chances of moisture seepage into the first and second adhesive layers from the surface of a polishing pad is greatly reduced. In addition, the seamless polymeric polishing pad also resists shearing forces from moving over rollers in a CMP system thus decreasing the chance that such forces would break down the polishing pad structure. As a result, polishing pad delamination is decreased significantly. Therefore, polishing pad life and production capacity of the present invention is increased dramatically over the production capacity of the prior art polishing pad. Such a large maximization of polishing belt life decreases CMP system downtime and in turn considerably increases wafer production efficiency and output.

Figure 5B:
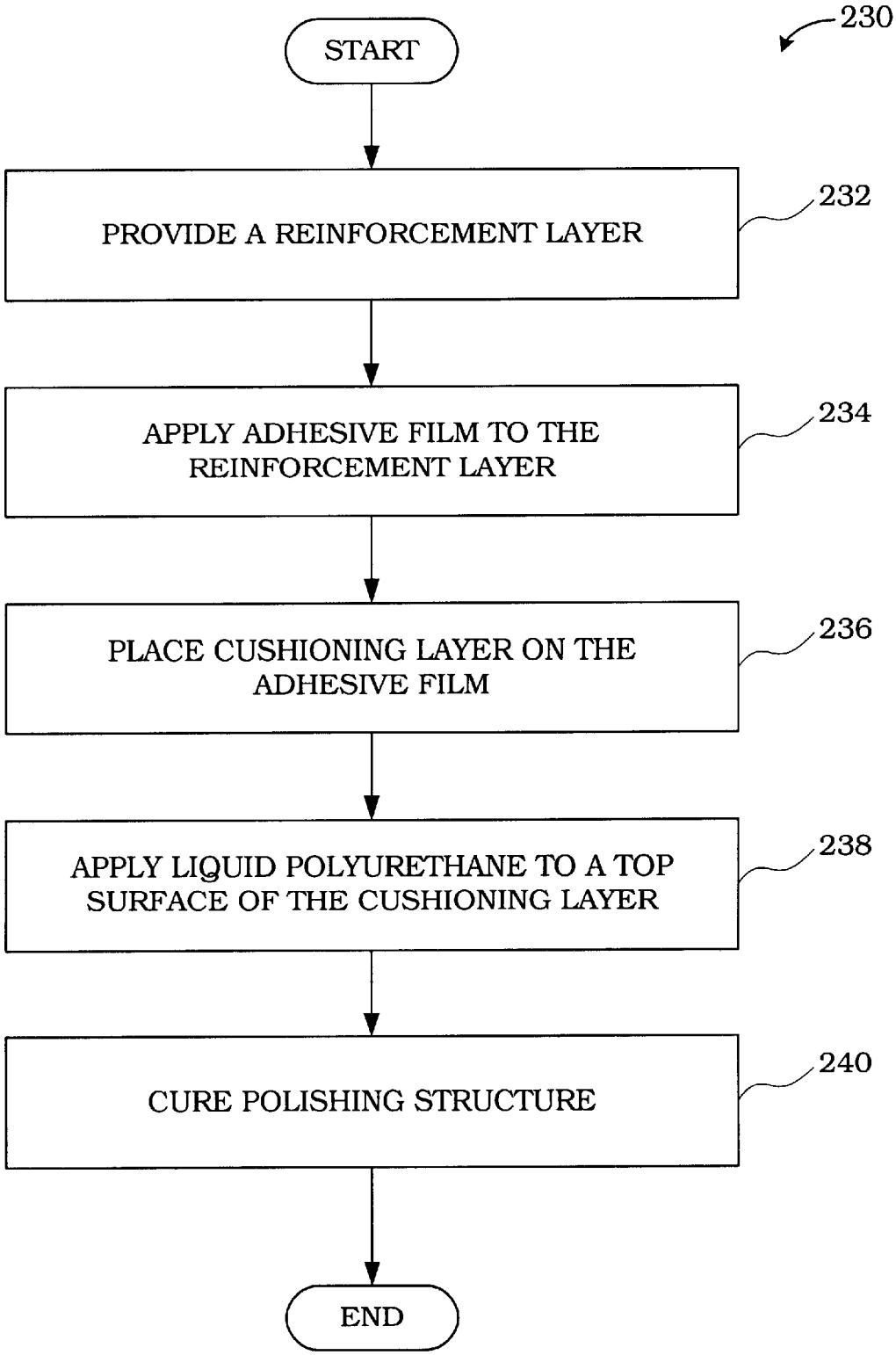
FIG. 5B illustrates shows a flowchart defining a method for generating a seamless polymeric polishing pad fused to a base belt in accordance with one embodiment of the present invention.

FIG. 5B illustrates shows a flowchart 230 defining a method for generating a seamless polymeric polishing pad fused to a base belt in accordance with one embodiment of the present invention. Operations 232, 234, and, 236 are substantially similar to operations 202, 204, and 206 respectively as discussed in reference to FIG. 5A. It should be understood that unlike the method disclosed in FIG. 5A, the method disclosed in FIG. 5B does not utilize an adhesive to attach the polishing pad to the base belt. Major differences in this embodiment from the method described. In reference to FIG. 5B starts from operation 238 where liquid polymeric material is applied to a top surface of the cushioning layer. It should be appreciated that the liquid polymeric material may be any type of polymeric precursor which may solidify into a material which can polish wafers. In one embodiment, the liquid polymeric material is a liquefied polyurethane. During operation 238, a liquid polymeric material penetrates into the pores of the cushioning layer. As discussed in reference to FIG. 2C, the liquid polymeric material may penetrate to any depth which can produce cohesive fusion between the resulting polymeric polishing pad and the cushioning layer. In one embodiment the liquid polymeric material penetrates to a depth of about 21 mils into the cushioning layer. Therefore, during a curing process described further in reference to operation 240, the liquid polymeric material forms into a seamless polymeric polishing pad which is fused to the cushioning layer.

After operation 238, the method proceeds to operation 240 where the polishing structure is cured. The curing process may be any temperature or any length of time as long as fusion between the cushioning layer and the polymeric polishing pad may be enhanced. In one embodiment, the polishing structure may be cured for about 18 hours at a temperature of about 212 F. In another embodiment, the polishing structure may be cured for about 20 hours at a temperature of about 200 F.

Besides strengthening the fusion between the polymeric polishing pad and the cushioning layer, operation 240 also generates a significant softening of the adhesive (as described above in reference to FIG. 5A) that holds together the cushioning and reinforcement layers. This softening creates flowing of the adhesive during a curing cycle and improves the strengthening of the adhesive by about a factor of 4 after a heating cycle. In one embodiment, the adhesive strength may be measured by a peel test where it is determined what force is necessary to peel the cushioning layer off of the reinforcement layer. It is believed that the softening and flowing of the adhesive film causes increased surface area contact between the adhesive and the cushioning layer.

Optionally, a protective liner may be added to a bottom surface of the reinforcement layer after operation 240. It should be understood that the protective liner may be any type of material that could reduce damage to a platen in a CMP system. In one embodiment, a polyethylene liner may be utilized to protect the platen on a CMP system from being scratched by the reinforcement layer during CMP process. It should be understood that the polyethylene liner may be any thickness which would not significantly increase shear forces on the polishing structure but which would protect the platen. In one embodiment, the protective liner may be between about 5 mils and about 50 mils in thickness. In another embodiment, the protective liner may be about 20 mils in thickness.

Consequently, the polishing structure is formed in a way that all of the layers are connected together in a much stronger way than prior art polishing apparatuses. As a result, the polishing structure of the present invention may withstand shearing and therefore resist delamination much better than the prior art. In addition, the polymeric polishing pad of the present invention is thin and does not have seams and therefore resists moisture intrusion into the inner portions of the polishing structures. This feature also decreases delamination and prolongs the life of the polishing structure. Further, the polishing structure of the present invention is thin and therefore less shearing forces act upon it (because more shearing forces exist toward the outside of the polishing structure when moving over a roller). Therefore, the polishing structure of the present invention may last longer, increase wafer throughput, and significantly decrease the costs of wafer processing.

Figure 6A:
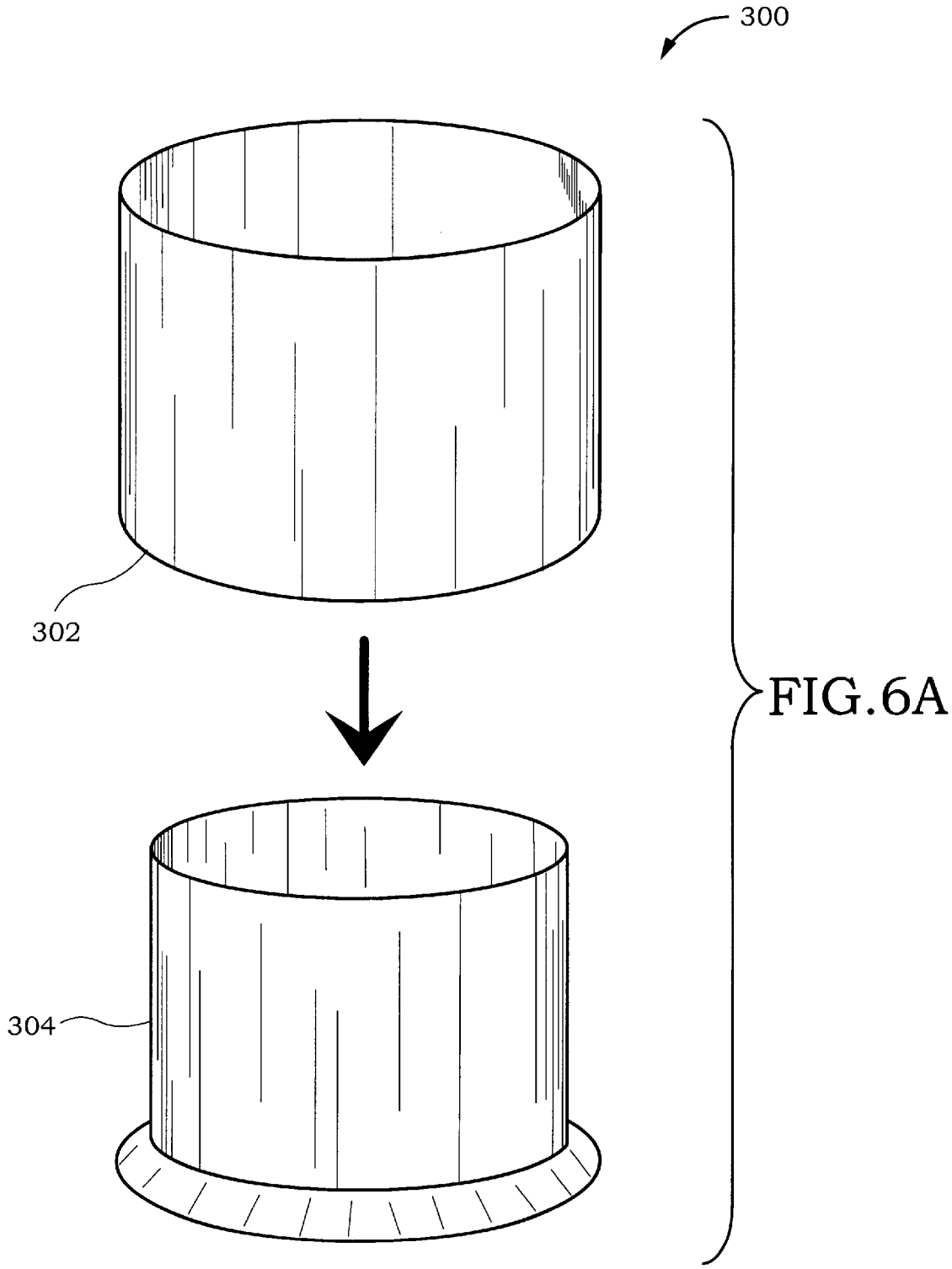
FIG. 6A shows two pieces of a polymeric polishing pad molding container in accordance with one embodiment of the present invention.

FIG. 6A shows two pieces of a polymeric polishing pad molding container 300 in accordance with one embodiment of the present invention. In this embodiment, an outside molding 302 fits over an inside molding 304. The outside molding 302 may be attached to the inside molding 304 in any way which would prevent escaping of liquid at an attachment juncture. In one embodiment, an adhesive may be utilized to attached the molding 302 to a base of the molding 304. A space within between the outside molding 302 and the inside molding 304 may be filled with a gel like substance to generate a polishing pad such as a polymeric polishing belt as described in further detail in reference to FIG. 7. It should be appreciated that the gel may be any type of precursor to a polymeric pad such as, for example, a polyurethane gel, etc. By having the outside molding 302 with a continuous inner surface and having the inside molding 304 with a continuous outer surface, a polymeric polishing pad that is shaped like a belt and that has no seams may be generated. In another embodiment, a polymeric polishing pad may be generated that is shaped like a belt and is a contiguous unit.

Figure 6B:
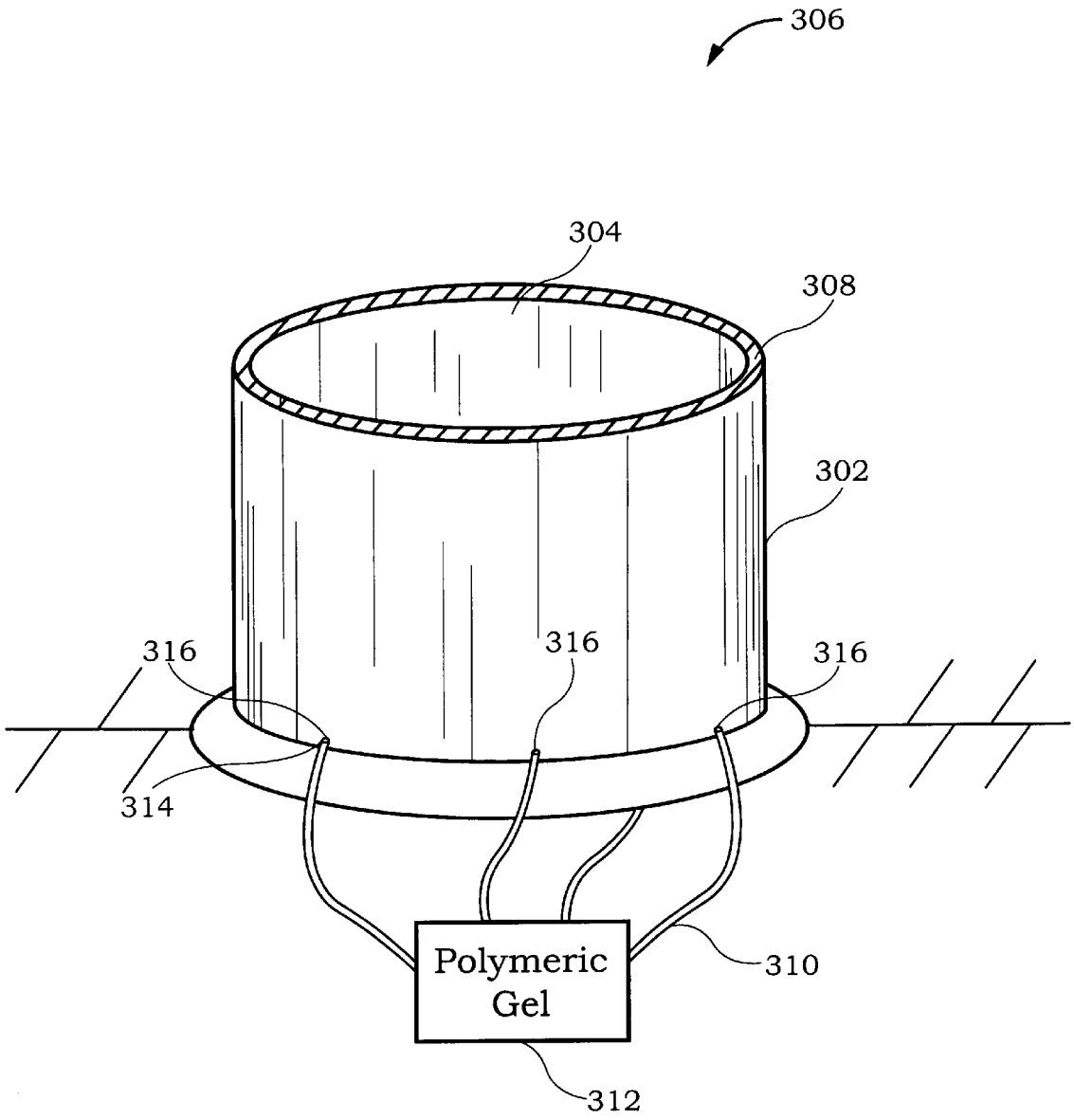
FIG. 6B shows a completed polymeric polishing pad molding container where an outside molding has been attached over an inside molding in accordance with one embodiment of the present invention.

FIG. 6B shows a completed polymeric polishing pad molding container 306 where an outside molding 302 has been attached over an inside molding 304 in accordance with one embodiment of the present invention. In this embodiment, a polymeric gel dispenser 312 inputs a polymeric gel 308 into a space between the outside molding 302 and the inside molding 304. The polymeric gel 308 may be any kind of substance that may be utilized to generate a polishing pad such as, for example, polyurethane gel, etc. The dispensing action may be completed through tubes 310 into input holes 316 at the base of the completed polymeric polishing pad molding container 306. It should be understood that any number of input holes may be utilized to fill the inside of the completed polymeric polishing pad molding container 306 such as, for example, 1, 2, 3, 4, etc. In one embodiment there are four input holes 316 at the base of the completed polymeric polishing pad molding container 306. By intelligently utilizing the molding container 306, a seamless polymeric polishing pad may be generated that reduces moisture intrusion into an inner structure of a polishing structure 180 (shown in FIGS. 2A–4).

Figure 7:
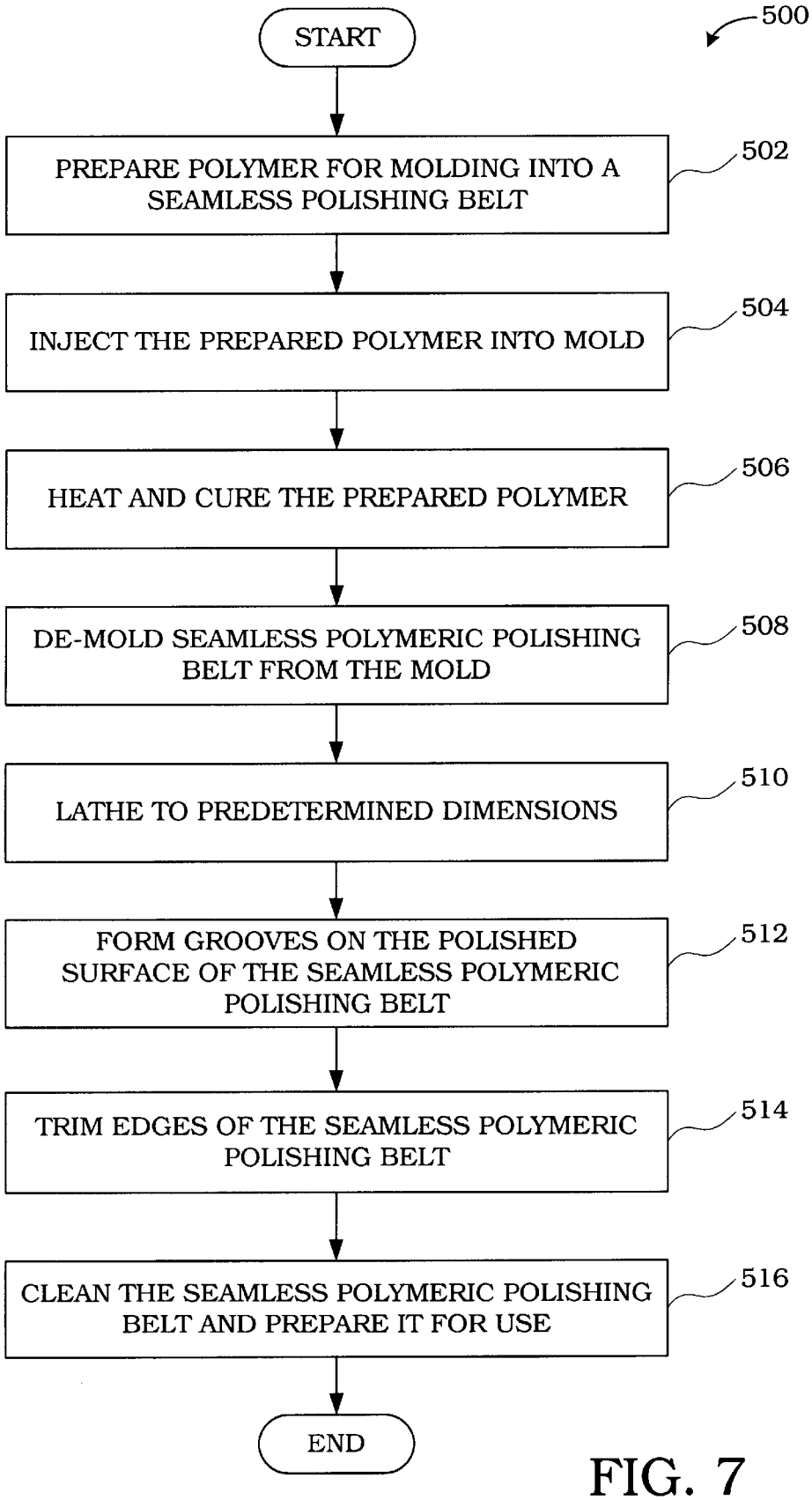
FIG. 7 is a flow chart illustrating a method for manufacturing a seamless polymeric polishing belt in accordance with one embodiment of the present invention.

FIG. 7 is a flow chart 500 illustrating a method for manufacturing a seamless polymeric polishing belt in accordance with one embodiment of the present invention. Although the operations herein show the method for manufacturing a seamless polishing belt, any other type of polishing pad may be generated by the operations as described below. The method begins at operation 502 where a polymer is prepared for molding into a seamless polishing belt. In one embodiment, a polymer material is prepared for molding into a seamless polymeric polishing belt utilizing a completed polymeric polishing pad molding container as described above in reference to FIG. 6B. Preferably, a two-part polyurethane mixture is used, although any type of polymer may be used depending on the polishing requirements. Generally, a flexible, durable, tough material is desired for the polishing layer of the seamless polymeric polishing belt so wafer surfaces may be polished. Further, the polishing layer should be soft enough to polish without scratching. The selected polymer need not be fully elastic, but should not slacken or loosen during use. Different polymers may be selected to enhance certain features of the polishing or planarizing process. In one embodiment, the polymer material may be a urethane mixture that produces a polishing material of the completed belt that is a microcellular polyurethane with a specific gravity of approximately 0.4–1.0p and a hardness of approximately 2.5–90 shore D. A liquid resin and a liquid curative are combined to form the polyurethane mixture. In another embodiment, a polymeric gel may be utilized to form a polishing pad as discussed above in reference to FIG. 6B. As can be appreciated, this operation may utilize any number of polymeric gel precursors to form the seamless polymeric polishing belt.

After operation 502, the method proceeds to operation 504 where the prepared polymer is injected into the mold. In one embodiment, urethane or other polymer material is dispensed into a hot cylindrical mold. It should be understood that other types and shapes of molds may be suitably used.

Then, in operation 506, the prepared polymer is heated and cured. It should be understood that any type of polymer may be heated and cured in any way that would produce the physical characteristics desired in a finished polishing pad. In one embodiment, a urethane mixture is heated and cured for a predetermined time at a predetermined temperature to form a urethane polishing layer. In one embodiment, a urethane mixture is cured for about 12–48 hours at about 150–300 degrees F (about 65–150 degrees C). In another embodiment, a polymeric gel precursor may be cured for about 20 hours at about 200 degrees F (about 93 degrees C). Other times and temperatures suitable to other polymer material as and other desired properties may be substituted. For example, thermoplastic materials are processed hot and set by cooling. After operation 506, the method advances to operation 508 where a seamless polymeric polishing belt is de-molded by removing the belt from the mold. In one embodiment, the mold is a polymeric polishing belt molding container as described in further detail in reference to FIG. 6B. Then operation 510 lathes the seamless polymeric polishing belt to predetermined dimensions. In operation 510, the seamless polymeric polishing belt is cut to the desired thickness and dimensions for optimal wafer polishing.

After operation 510, the method proceeds to operation 512 where grooves are formed on a polishing surface of the seamless polymeric polishing belt. The grooves may be formed during molding by providing a suitable pattern on the inside of the mold. In one embodiment, the raw casting is turned and grooved on a lathe to produce a smooth polishing surface with square shaped grooves.

The polishing belt is then finished for use. After operation 512, the method moves to operation 514 where the edges of the seamless polymeric polishing belt are trimmed. Then operation 516 cleans the seamless polymeric polishing belt and prepares it for use. In one embodiment, the seamless polymeric polishing belt is 90–110 inches in length, 8–16 inches wide and 0.020–0.2 inches thick. It is therefore suitable for use in the Teres™ linear polishing apparatus manufactured by Lam Research Corporation. Therefore, the seamless polymeric polishing belt reduces moisture intrusion into the base belt underneath the polishing belt thereby greatly increasing the useful life of the polishing material. As a result, wafer production may be increased and wafer production consistency may be enhanced. Because of this enhanced and optimized nature of the present invention, wafer production costs may ultimately be decreased.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A seamless polishing apparatus for utilization in chemical mechanical polishing, comprising:

a polishing pad, the polishing pad being shaped like a belt and configured to have no seams; and a base belt, the base belt including a reinforcement layer and a cushioning layer;

wherein the cushioning layer is an intermediary layer between the polishing belt pad and the base belt.

2. A seamless polishing apparatus for utilization in chemical mechanical polishing as recited in claim 1, wherein the polishing pad is a polymeric material.

3. A seamless polishing apparatus for utilization in chemical mechanical polishing as recited in claim 2, wherein the polymeric material is polyurethane.

4. A seamless polishing apparatus for utilization in chemical mechanical polishing as recited in claim 1, wherein the cushioning layer is a sponge like material.

5. A seamless polishing apparatus for utilization in chemical mechanical polishing as recited in claim 1, wherein the cushioning layer is an open-celled polyurethane material.

6. A seamless polishing apparatus for utilization in chemical mechanical polishing as recited in claim 1, wherein the reinforcement layer is a steel layer.

7. A seamless polishing apparatus for utilization in chemical mechanical polishing as recited in claim 1, wherein the polishing pad is about 40 mils in thickness.

8. A seamless polishing apparatus for utilization in chemical mechanical polishing as recited in claim 1, wherein the cushioning layer is about 20 mils in thickness.

9. A seamless polishing apparatus for utilization in chemical mechanical polishing as recited in claim 1, further comprising:

a cap covering an adhesive film between the base belt and the polishing pad.

10. A seamless polishing apparatus for utilization in chemical mechanical polishing as recited in claim 9, wherein the cap is a polymeric material.

11. A seamless polishing apparatus for utilization in chemical mechanical polishing as recited in claim 1, further comprising:

a cover configured to seal off an adhesive film between the base belt and the polishing pad from moisture intrusion.

12. A seamless polishing apparatus for utilization in chemical mechanical polishing as recited in claim 1, wherein the base belt and the polishing pad are attached by a first adhesive film, and the reinforcement layer and the cushioning layer are attached by a second adhesive film.

13. A seamless polishing apparatus for utilization in chemical mechanical polishing, comprising:

a polishing pad, the polishing pad being shaped like a belt and configured to have no seams; and a base belt, the base belt including a reinforcement layer and a cushioning layer, the reinforcement layer being a steel layer;

wherein the cushioning layer is an intermediary layer between the continuous pad and the reinforcement layer.

14. A seamless polishing apparatus for utilization in chemical mechanical polishing as recited in claim 13, wherein the polishing pad is a polymeric material.

15. A seamless polishing apparatus for utilization in chemical mechanical polishing as recited in claim 13, wherein the polishing pad is between about 30 mils and about 100 mils in thickness.

16. A seamless polishing apparatus for utilization in chemical mechanical polishing as recited in claim 13, wherein the cushioning layer is between about 10 mils and about 100 mils in thickness.

17. A seamless polishing apparatus for utilization in chemical mechanical polishing as recited in claim 13, wherein the reinforcement layer is between about 5 mils and about 50 mils in thickness.

18. A polishing structure for utilization in chemical mechanical polishing, comprising:

a polishing pad, the polishing pad being shaped like a belt and configured to be a contiguous unit, the polishing pad being made of a polymeric material; and a base belt, the base belt including a reinforcement layer and a cushioning layer, the reinforcement layer being a steel layer;

wherein the cushioning layer is an intermediary layer between the polishing pad and the reinforcement layer, the cushioning layer being a polymeric material.

19. A polishing structure for utilization in chemical mechanical polishing as recited in claim 18, wherein the steel layer and the cushioning layer are attached by a first adhesive film, and the cushioning layer and the polishing pad are attached by a second adhesive film.

20. A seamless polishing apparatus for utilization in chemical mechanical polishing, comprising:

a polishing pad, the polishing pad being shaped like a belt and configured to be a contiguous unit and to have grooves on a pad surface, the polishing pad being made up of polyurethane; and a base belt, the base belt including a reinforcement layer and a cushioning layer, the reinforcement layer being a steel layer, the reinforcement layer and the cushioning layer being attached by way of a first adhesive film, the base belt and the polishing pad being attached by way of a second adhesive film;

wherein the cushioning layer is an intermediary between the polishing pad and the reinforcement layer, the cushioning layer being a polyurethane material.

21. A seamless polishing apparatus for utilization in chemical mechanical polishing as recited in claim 20, wherein the polishing pad is between about 40 mils in thickness.

22. A seamless polishing apparatus for utilization in chemical mechanical polishing as recited in claim 20, wherein the cushioning layer is about 20 mils in thickness.

23. A seamless polishing apparatus for utilization in chemical mechanical polishing as recited in claim 20, wherein the reinforcement layer is about 20 mils in thickness.

24. A seamless polishing apparatus for utilization in chemical mechanical polishing, comprising:

a polishing pad, the polishing pad being shaped like a belt and configured to be a contiguous unit;

a base belt, the base belt including a reinforcement layer and a cushioning layer; and a cap covering an adhesive film between the base belt and the polishing pad;

wherein the cushioning layer is an intermediary between the continuous pad and the base belt.

25. A seamless polishing apparatus for utilization in chemical mechanical polishing as recited in claim 24, wherein the polishing pad is polyurethane.

26. A seamless polishing apparatus for utilization in chemical mechanical polishing as recited in claim 24, wherein the reinforcement layer is a steel layer.

27. A seamless polishing apparatus for utilization in chemical mechanical polishing, comprising:

a polishing pad, the polishing pad being shaped like a belt and configured to have no seams, and the polishing pad being made of a polymeric material, and the polishing pad being between about 30 mils and about 100 mils in thickness and configured to have a grooved top surface; and a base belt, the base belt including a reinforcement layer and a cushioning layer, the reinforcement layer being a stainless steel layer, and the cushioning layer being between about 10 mils and about 100 mils in thickness, and the reinforcement layer being between about 5 mils and 50 mils in thickness;

wherein the cushioning layer is an intermediary layer between the polishing belt pad and the base belt.

28. A method for generating a polishing pad structure for utilization in chemical mechanical polishing, comprising:

providing a reinforcement layer;

applying a first adhesive film over the reinforcement layer;

attaching a cushioning layer on the first adhesive film;

applying a second adhesive film over the cushioning layer;

attaching a seamless polishing pad on the second adhesive film; and curing the polishing pad structure.

29. A method for generating a polishing pad structure for utilization in chemical mechanical polishing as recited in claim 28 wherein the reinforcement layer is a steel layer.

30. A method for generating a polishing pad structure for utilization in chemical mechanical polishing as recited in claim 28 wherein the first adhesive layer and the second adhesive layer is a rubber based adhesive.

31. A method for generating a polishing pad structure for utilization in chemical mechanical polishing as recited in claim 28 wherein the seamless polishing pad is generated by pouring a polymeric gel into a mold.

32. A method for generating a polishing pad structure for utilization in chemical mechanical polishing as recited in claim 28 wherein the seamless polishing pad is a polymeric material.

33. A method for generating a polishing pad structure for utilization in chemical mechanical polishing as recited in claim 28 wherein the curing includes heating the polishing pad structure.

34. A method for generating a polishing pad structure for utilization in chemical mechanical polishing, comprising:

providing a reinforcement layer;

applying a first adhesive film on the reinforcement layer;

attaching a cushioning layer on the first adhesive film;

applying a second adhesive film on the cushioning layer;

attaching a seamless polymeric polishing pad on the second adhesive layer, the polymeric polishing pad having a grooved top surface; and curing the polishing pad structure between about 12 hours to about 48 hours at a temperature of between about 150 F to 300 F.

35. A method for generating a polishing pad structure for utilization in chemical mechanical polishing, comprising:

providing a reinforcement layer;

applying a first adhesive film on the reinforcement layer;

attaching a cushioning layer on the first adhesive film;

applying a second adhesive film on the cushioning layer;

attaching a seamless polymeric polishing pad on the second adhesive layer, the polymeric polishing pad having a grooved top surface, the seamless polishing pad being generated by pouring a polymeric gel into a mold; and curing the polishing pad structure for about 20 hours in a temperature of about 200 F.

* * * * *